US005224625A

United States Patent [19]

Holtier

[11] Patent Number: 5,224,625

[45] Date of Patent: Jul. 6, 1993

[54] SPRAY APPARATUS HAVING PUMPING MECHANISM AND CONTROL MEANS THEREFOR

[75] Inventor: Eugene S. Holtier, Olmsted Township, Cuyahoga County, Ohio

[73] Assignee: Those Characters From Cleveland, Cleveland, Ohio

[21] Appl. No.: 726,849

[22] Filed: Jul. 8, 1991

[51] Int. Cl.[5] ..... B67B 7/00

[52] U.S. Cl. ..... 222/1; 222/63; 222/78; 222/529; 200/83 B

[58] Field of Search ..... 222/52, 55, 63, 79, 222/78, 321, 380, 529; 239/333; 200/81 R, 81.6, 81.9 R, 83 B

[56] References Cited

U.S. PATENT DOCUMENTS

| | | | |
|---|---|---|---|
| 1,635,978 | 7/1927 | Ross . | |
| 2,285,292 | 6/1942 | Mangels | 221/31.5 |
| 2,686,281 | 8/1954 | Shum | 318/127 |
| 2,969,921 | 1/1961 | Tygart | 239/99 |
| 3,139,280 | 6/1964 | Kripak | 272/27 |
| 3,374,708 | 3/1968 | Wall | 89/1 |
| 3,386,622 | 6/1968 | Cox et al. | 222/76 |
| 3,423,551 | 1/1969 | Starbuck | 200/83 B |
| 3,729,863 | 5/1973 | Asano | 46/92 |
| 3,836,057 | 9/1974 | MacManus | 222/79 |
| 3,901,449 | 8/1975 | Bochmann | 239/332 |
| 3,987,869 | 10/1976 | Bowers | 184/105 |
| 4,022,350 | 5/1977 | Amrom | 222/79 |
| 4,154,375 | 5/1979 | Bippus | 222/325 |
| 4,563,179 | 1/1986 | Sakai | 200/81 R |
| 4,651,903 | 3/1987 | Pagliai | 222/175 |
| 4,706,848 | 11/1987 | D'Andrade | 222/79 |
| 4,768,681 | 9/1988 | Dean et al. | 222/79 |
| 4,903,864 | 2/1990 | Sirhan | 222/78 |
| 5,074,437 | 12/1991 | D'Andrade et al. | 222/79 |

FOREIGN PATENT DOCUMENTS

| | | | |
|---|---|---|---|
| 667463 | 3/1952 | United Kingdom | 548/50 |
| 2220582 | 1/1990 | United Kingdom | 222/78 |

*Primary Examiner*—Gregory L. Huson
*Attorney, Agent, or Firm*—Calfee, Halter & Griswold

[57] ABSTRACT

A spray apparatus includes a spray device which indirectly controls the activation and deactivation of a pump in a remote pumping mechanism. The spray device includes a control assembly which is adapted to control the fluid flow through the device. The control assembly includes a button which is normally biased into engagement with a fluid passage and can be manually manipulated to allow fluid to flow through the passage. The fluid passage in the spray device is connected by a conduit to the pumping mechanism. The pumping mechanism includes a pump, a fluid reservoir, and a pressure sensitive switch mounted within a housing. When activated, the pump draws fluid from the reservoir and forces the fluid through the pressure sensitive switch and the conduit to the fluid passage in the spray device. The button in the control assembly can be manually manipulated to selectively allow fluid to flow through the fluid passage and out through a nozzle in the spray device in the form of a stream or spray. When the button is not manipulated, the increase in pressure in the fluid passage, the conduit, and the pressure sensitive switch causes the pressure sensitive switch to deactivate the pump.

27 Claims, 5 Drawing Sheets

SPRAY APPARATUS HAVING PUMPING MECHANISM AND CONTROL MEANS THEREFOR

TECHNICAL FIELD

The present invention relates to a spray apparatus having a spray device which indirectly controls the activation and deactivation of a pump in a remote pumping mechanism.

BACKGROUND

A myriad of apparatus have been developed for providing a controlled stream of fluid. As is typical of these apparatus, a water reservoir supplies water to a pump located within a housing. When activated, the pump forces the water through a nozzle in the housing in a stream or a spray.

For example, toys have been developed a trigger controls the activation or deactivation of a pump and provides a stream of fluid through a nozzle in the toy. In particular, Amron, U.S. Pat. No. 4,022,350, shows a toy water gun having a water reservoir and a battery-driven pump located within a housing. The pump supplies water under pressure to a nozzle located on the housing of the gun. The pump is activated when a trigger attached to the housing is pulled to complete a normally-open electrical circuit between the batteries and the pump. The pump is deactivated when the trigger is released.

Similarly, D'Andrade, U.S. Pat. No. 4,706,848, also shows a battery-operated water gun having a water reservoir and a pump located within a housing. The pump includes a rotatable step-function drop off cam that provides a stream of water through a nozzle located on the housing of the gun. The pump is activated when a trigger attached to the housing is pulled. Similarly, the pump is deactivated when the trigger is released.

Additionally, apparatus have been developed for providing a controlled stream of fluid in which a trigger is located externally of the housing to control the activation and deactivation of a pump. In particular, Bowens, U.S. Pat. No. 3,987,869, shows a lubrication system having a pair of grease cylinders removeably mounted to a base. The cylinders provide grease through an auger drive to a remote grease gun at the end of a hose. A trigger on the remote grease gun is electrically connected to a pump motor on the base and is adapted to complete an electrical circuit between the motor and a power pack when pulled. Alternatively, the trigger is released, the motor is deactivated.

Similarly, Cox, et al., U.S. Pat. No. 3,386,622, shows a similar apparatus in which a contact switch on a remote grease gun controls the activation and deactivation of a pump in a housing. The contact switch is electrically connected to the housing and is adapted to selectively complete an electrical circuit between a battery and the pump to activate and deactivate the pump.

Further, an apparatus has been developed in which a switch located externally on the housing controls the activation and deactivation of a pump. Bochmann, U.S. Pat. No. 3,901,449, shows an electric sprayer having a pump and a fluid tank located within a housing. A switch located on the exterior of the housing controls the activation and deactivation of the pump by selectively completing an electrical circuit between the pump and a set of batteries. A flexible tube connects the outlet of the pump with discharge equipment pivotally attached to the exterior housing of the sprayer. The tube is surrounded by a coil spring which is adapted to constrain the tube when the fluid pressure increases within the tube. The coiled tube is adapted to oscillate with its diameter and length changing so as to dampen the pressure and velocity fluctuations within the tube.

Although the above-mentioned apparatus provide a controlled stream of fluid under pressure to a nozzle, the pumps in the apparatus are specifically designed to operate when a switch or trigger either attached to or located exterior of the housing of the apparatus is activated or pulled. The pumps are inoperative when the trigger is released or when the switch is deactivated. The switch or trigger selectively completes an electrical circuit between a power supply, e.g. batteries, and the pump to activate or deactivate the pump.

SUMMARY OF THE INVENTION

The present invention provides a new and useful spray apparatus having a spray device which indirectly controls the activation and deactivation of a pump in a pumping mechanism. The pumping mechanism includes a housing enclosing a fluid reservoir, a battery-operated pump, and a pressure-sensitive switch which controls the activation and deactivation of the pump.

The pump in the pumping mechanism is adapted to draw fluid from a suction tube extending into the fluid reservoir and apply the fluid under pressure through the pressure sensitive switch. The pressure sensitive switch includes a bellows which consists of a longitudinally extending section of flexible plastic tubing located between two support members. The inlet of the bellows is connected through a short fluid tube to the pump, while the outlet of the bellows is connected through a fluid conduit to the spray device.

Two contact members extend over the outward circumference of the bellows and are normally biased into electrical contact with each other when the bellows is deflated. The contact members are included within an electrical circuit between the pump and a set of batteries located within the housing. When the bellows is deflated, the contact members are biased together to establish electrical continuity between the batteries and the pump to thereby activate the pump. However, when the bellows are expanded, the contact members are forced out of contact with each other to interrupt the electrical continuity and thereby deactivate the pump.

The spray device includes a control assembly which controls the flow of fluid through a fluid passage in the device. The control assembly includes a button normally biased into engagement with the fluid passage to prevent fluid from flowing through a nozzle in the spray device. The button can be manually urged against its bias and out of engagement with the fluid passage wall to selectively allow fluid to flow through the passage and out through the nozzle. The control assembly in the spray device indirectly controls the activation and deactivation of the pump in the pumping mechanism by controlling the pressure in the fluid passage. An increase in fluid pressure in the fluid passage increases the pressure in the conduit and the pressure sensitive switch, which expands the bellows and deactivates the pump.

The pump includes a piston which is adapted to reciprocate within a chamber to force fluid through the pressure sensitive switch to the spray device. The piston is normally spring-biased forwardly within the chamber, and includes an L-shaped shoulder member extending outwardly therefrom. A stop extending from the shoulder member is adapted to be alternatively engaged and disengaged by a rotating cam driven by a pump motor. The cam engages the stop to alternatingly move the shoulder member, and hence the piston, forwardly and rearwardly within the chamber. When the piston moves rearwardly within the chamber, fluid is drawn into the chamber. As the piston moves forwardly within the chamber, the fluid is forced through the fluid conduit to the spray device.

A sliding switch is included within the electrical circuit between the contact members, pump and batteries. The switch is initially set to an "on" position. The contact members around the collapsed bellows complete the electrical circuit between the pump and the batteries to thereby activate the pump and supply fluid to the spray device.

When an increase in fluid pressure exists within the pressure sensitive switch, such as when the button in the control assembly is urged into engagement with the fluid passage in the spray device, the bellows expands as the pump continues to force fluid through the pressure sensitive switch. The expanded bellows disengage the contact members and thereby inactivate the pump. The closed fluid passage in the spray device and inactivated pump prevent additional fluid flow through the nozzle in the spray device. Alternately, when the pressure decreases within the bellows, such as when the button is urged out of engagement with the fluid passage in the spray device, the bellows deflates and the contact members engage to activate the pump.

One feature of the present invention is that the pump in the pumping mechanism is responsive to the manipulation of the button in the control assembly of the remote spray device. The button in the control assembly is normally biased into engagement with the fluid passage to prevent fluid flow through the nozzle of the spray device. Interrupting the fluid flow through the spray device will increase the pressure in the pressure sensitive switch and thereby expand the bellows. The expanded bellows in turn deactivates the pump in the pumping mechanism. Accordingly, in an unused or unattended position, fluid will not flow through the nozzle in the spray device.

Another feature of the present invention is that the button in the control assembly can be manually manipulated to allow fluid to flow through the nozzle in the spray device. The flow of fluid through the nozzle deflates the bellows and activates the pump in the pumping mechanism. The button on the spray device thereby indirectly controls the activation and deactivation of the pump in the remote pumping mechanism by controlling the flow of fluid through the spray device.

Still another feature of the present invention is that the electrical circuit for the pump is contained wholly within the housing of the pumping mechanism. The control for the pump, e.g., the button in the control assembly, is not electrically connected within the electrical circuit in the pumping mechanism, which can increase the safety, aesthetic appeal and flexibility of the spray assembly.

Further features and advantages of the present invention will become apparent from the following detailed description and the accompanying drawings.

DETAILED DESCRIPTION OF THE PREFERRED EMBODIMENT

Figure 1:
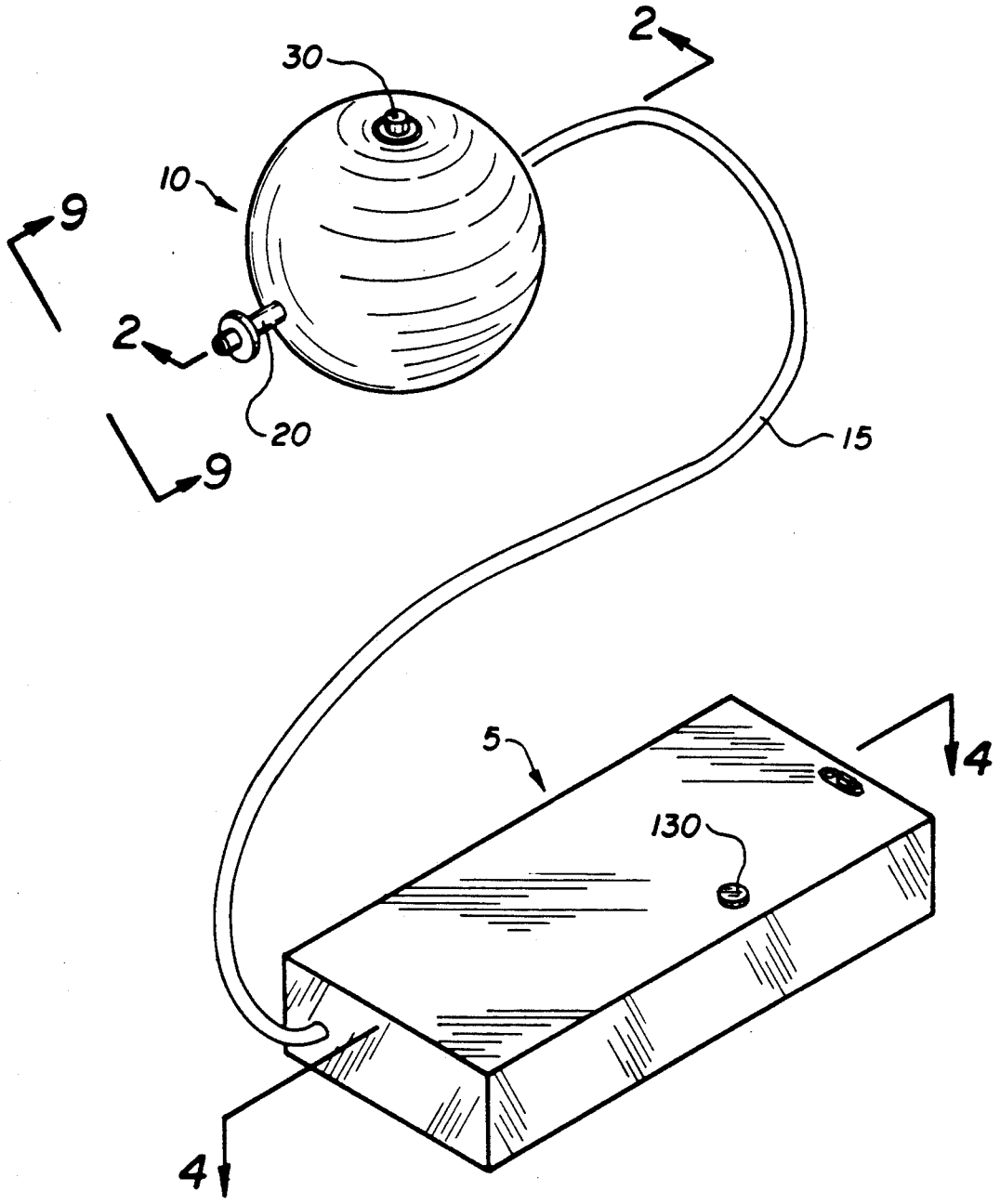
FIG. 1 is a perspective view of the pumping mechanism and spray device constructed according to the present invention.

As shown in FIG. 1, the present invention relates to a spray apparatus having a pumping mechanism, indicated generally at 5, and a spray device, indicated generally at 10, connected by a fluid conduit 15. The spray apparatus 5 is adapted to provide a stream or spray of fluid from a nozzle 20 in the spray device 10. The spray device 10 is illustrated having a substantially spherical appearance, however, the spray device can be manufactured in any selected shape and is particularly adapted to be incorporated within a figurine or toy (not shown).

Figure 2:
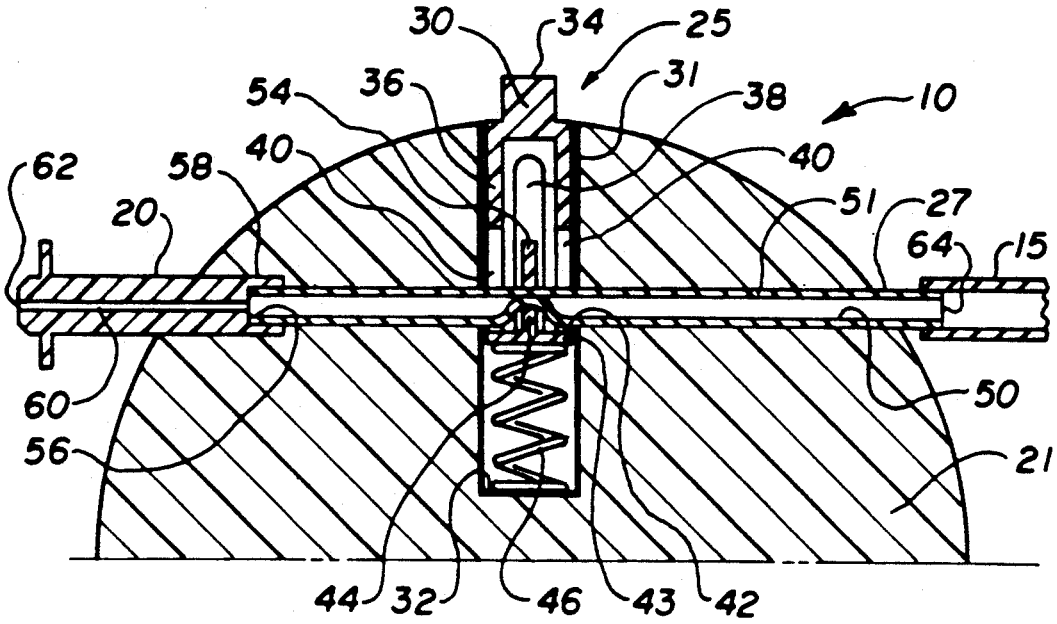
FIG. 2 is a sectional illustration of the spray device taken substantially along the plane described by the line 2—2 in FIG. 1, and illustrating the interrupted position of the fluid passage.

As shown in FIG. 2, the spray device 10 includes a body 21 enclosing a control assembly, indicated generally at 25, and a fluid passage 27. The control assembly 25 is adapted to control the flow of fluid through the fluid passage 27. To this end, the control assembly 25 includes a button 30 slidingly received within a cylinder 31. The cylinder 31 includes a bottom surface 32, and is located within a bore (unnumbered) extending radially inward from the outer surface of the device 10. The button 30 includes an outwardly projecting contact surface 34 and a body 36. The body 36 includes a hollow central portion 38 having apertures 40 formed in opposite sides. The bottom surface 42 of the button 30 is connected to a fluid cut-off member 43. Fluid cut-off member 43 includes an upwardly projecting flange 44 which has an inverted T-shaped design and extends into the hollow central portion 38 of button body 36.

The fluid passage 27 is formed from relatively rigid elastomeric material and extends laterally through a radial bore (unnumbered) formed in the body 21 of spray device 10; through apertures (unnumbered)

formed in cylinder 31; and through the apertures 40 and hollow central portion 38 formed in button 30. A spring 46 is located between the fluid cut-off member 43 and the bottom surface 32 of cylinder 31. The spring 46 normally biases button 30 upwardly within cylinder 31, such that flange 44 of cut-off member 43 engages lower side wall 50 of fluid passage 27, as illustrated in FIG. 2. Flange 44 forces lower side wall 50 of fluid passage 27 into engagement with upper side wall 51 to interrupt the fluid flow within the fluid passage. The upper wall 51 is retained in a substantially linear relation by projecting member 54 formed within cylinder 31 and extending into the central portion 38 of button 30.

Figure 3:
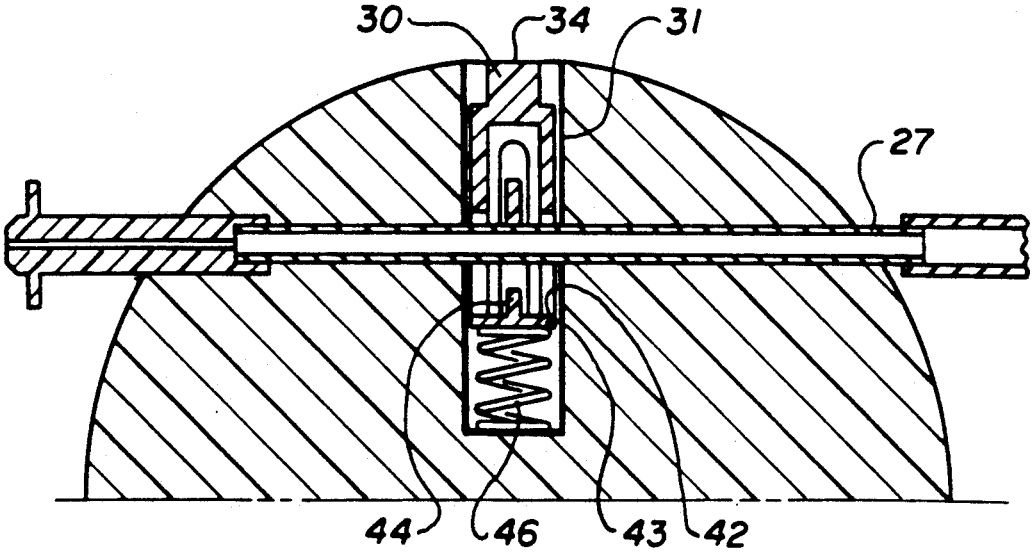
FIG. 3 is a sectional illustration of the spray device taken substantially along the plane described by the line 2—2 in FIG. 1 and illustrating the uninterrupted position of the fluid passage.

The contact surface 34 of button 30 is adapted to be manually depressed downwardly within cylinder 31 to force the button 30 against the spring bias and move the flange 44 of fluid cut-off member 43 out of engagement with lower side wall 50, as illustrated in FIG. 3. When button 30 is manually depressed, fluid can flow within the fluid passage 27. However, when the button 30 is subsequently released, the spring 46 biases the fluid cut-off member 43 back into engagement with the fluid passage 27 to restrict the fluid flow therein, as illustrated in FIG. 2.

The spray nozzle 20 is received in a larger counter bore formed axially with the fluid passage bore. The output end 56 of fluid passage 27 is received within a sleeve 58 formed in one piece with and extending inwardly from spray nozzle 20. Nozzle 20 includes a central aperture 60 designed to allow fluid to flow from fluid passage 27 through the tip 62 of nozzle 20 in a stream or spray.

The input end 64 of the fluid passage 27 is received within and is fluidly connected to fluid conduit 15, which extends between the spray device 10 and the pumping mechanism 5 (FIG. 1). Conduit 15 is formed from conventional flexible elastomeric material and is preferably transparent.

Figure 4:
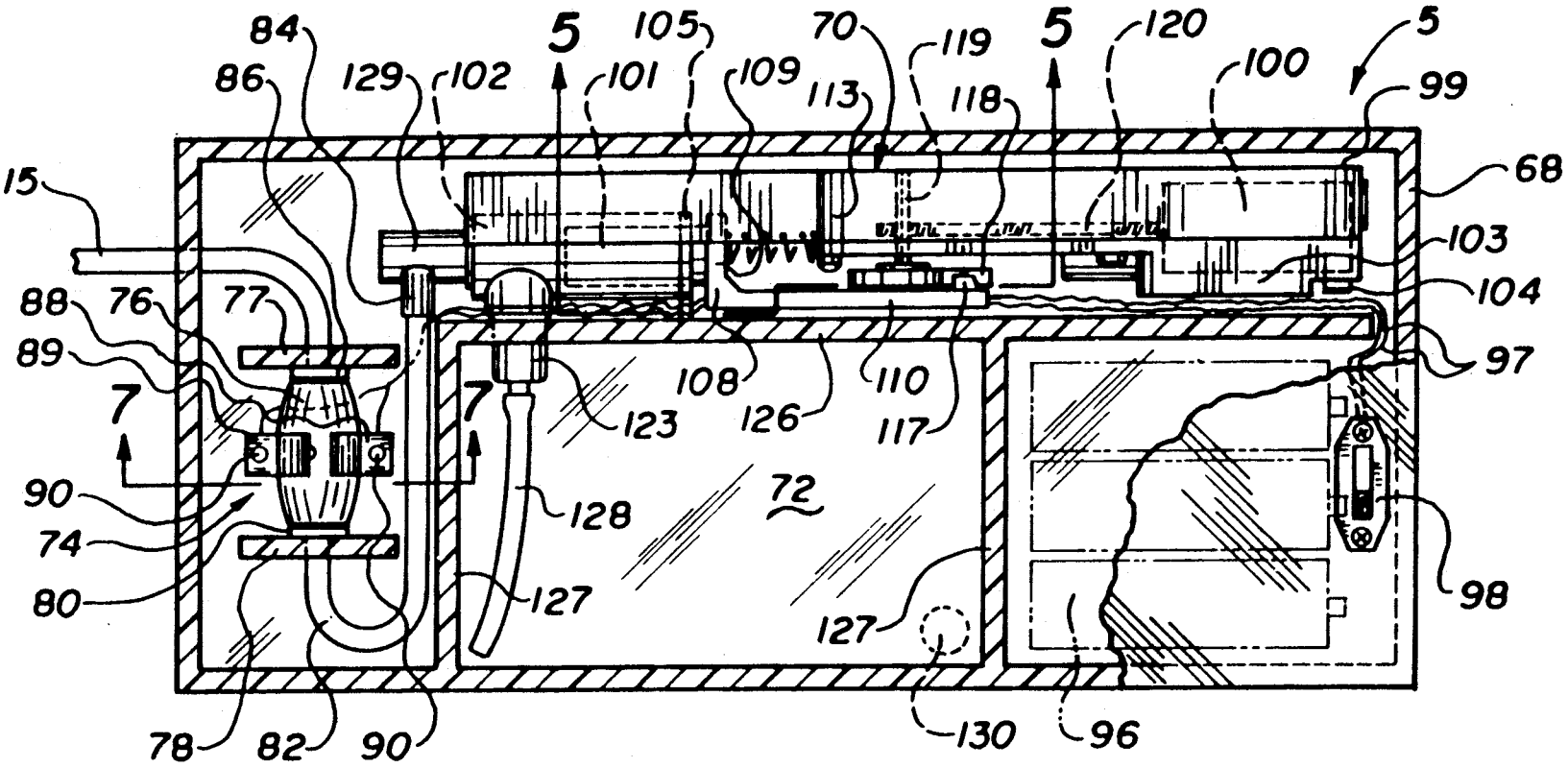
FIG. 4 is a sectional view of the pumping mechanism taken substantially along the plane described by the line 4—4 in FIG. 1.

Referring now to FIG. 4, the pumping mechanism 5 consists of a housing 68 enclosing a reciprocating pump, indicated generally at 70, a fluid reservoir 72 and a pressure-sensitive switch, indicated generally at 74. The switch 74 includes a longitudinally extending section of flexible plastic tubing forming a bellows 76. The bellows 76 is disposed between two support members 77, 78 attached to housing 68. The input end 80 of the bellows 76 is connected through a short fluid line 82 to the outlet port 84 of the pumping mechanism 70; while the output end 86 of the bellows 76 is connected through fluid conduit 15 to the spray device 10 (FIG. 1).

Figure 7:
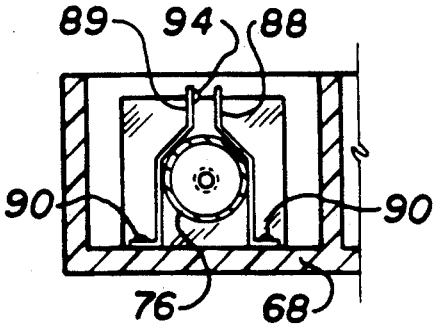
FIG. 7 is a partial front view of the switch assembly, taken substantially along the plane described by the line 7—7 in FIG. 4, illustrating the expanded bellows.
Figure 8:
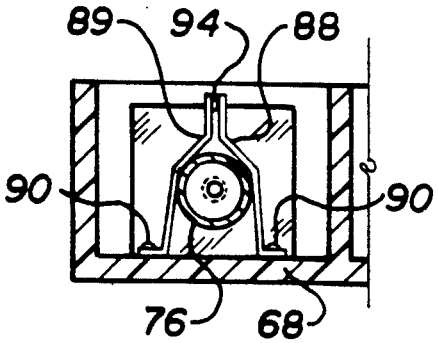
FIG. 8 is a partial front view of the switch assembly, taken substantially along the plane described by the line 7—7 in FIG. 4, illustrating the deflated bellows.

As shown in FIGS. 4, 7 and 8, the pressure-sensitive switch 74 further includes two contact members 88, 89 which are attached by rivets 90 or other fasteners to the housing 68 of the pumping mechanism. Each contact member 88, 89 is formed from conductive material and extends over a portion of the outward circumference of the bellows 76. The contact members 88, 89 are normally biased inwardly into engagement and are adapted to establish electrical continuity thereacross. To facilitate electrical continuity, a contact nub 94 is formed on contact member 89, and is normally urged against contact member 88, to thereby establish the electrical continuity.

The contact members 88, 89 are incorporated within an electrical circuit between the pump 70 and a set of batteries 96 (shown in phantom). The electrical circuit can be formed by one of ordinary skill in the art by using a plurality of wires 97 to interconnect the pump, contact members and batteries. Accordingly, when contact nub 94 on contact member 89 is in electrical contact with contact member 88, the batteries 96 apply an appropriate voltage to activate the pump 70. Alternatively, when the contact members 88, 89 are separated, an open circuit is created between the pump and the batteries, and the pump is deactivated. Sliding switch 98 can be included within the electrical circuit to provide for manual override of the activation and deactivation of the pump 70.

Figure 5:
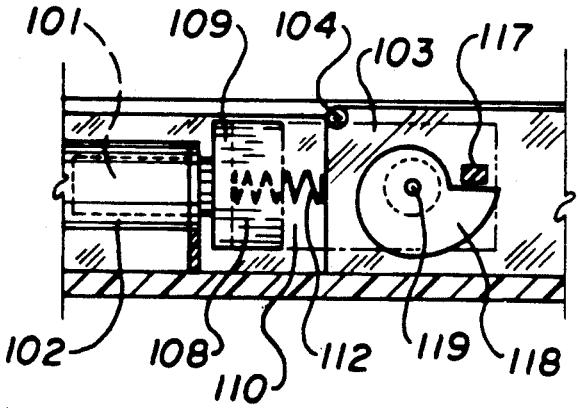
FIG. 5 is a partial sectional view of the pumping mechanism taken substantially along the plane described by the line 5—5 of FIG. 4, and illustrating the forward movement of the reciprocating piston.
Figure 6:
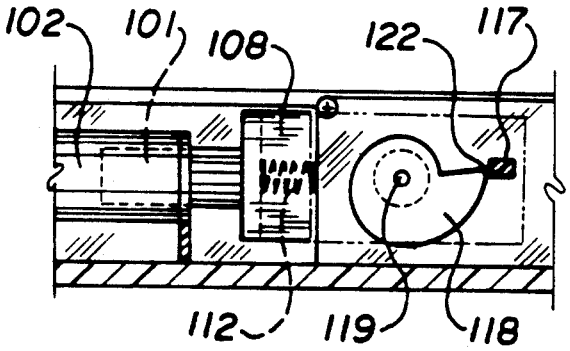
FIG. 6 is a partial sectional view of the pumping mechanism, taken substantially along the plane described by the line 5—5 of FIG. 4, illustrating the rearward movement of the reciprocating piston.

As shown in FIGS. 4, 5 and 6, pump 70 includes a pump housing 99 enclosing a pump motor 100 (shown in phantom), and a spring-loaded piston 101 slidingly received within a piston chamber 102. A plate 103 is secured to a portion of the open side of housing 99 with screws 104 to at least partially enclose the pump motor 100.

The piston chamber 102 has one end which is connected by fluid tube 82 to the input end 80 of the bellows 76. the other end of chamber 102 includes an O-ring 105 which provides a seal between the open end of chamber 102 and piston 101. The piston 101 is adapted for reciprocating movement within chamber 102. To this end, the piston 101 includes an L-shaped shoulder member 108 which extends outwardly therefrom. The shoulder member 108 includes a base 109 and a wall 110. A spring 112 extends between base 109 and a sidewall 113 of plate 103 to bias piston 101 forwardly within chamber 102.

The wall 110 of shoulder member 108 includes an inwardly extending stop 117. The stop 117 is engaged by a cam 118 to alternatingly move the shoulder member 108, and hence the piston 101, within the chamber 102. To this end, cam 118 includes a cam shaft 119 rotatingly secured to pump housing 99 and extending through and supported by side plate 103. Pump motor 100 (FIG. 4) drives gear 120 in engagement with cam shaft 119 to rotate cam 118 in a clockwise direction. The rotating cam initially engages stop 117, and draws the piston 101 rearwardly out of the piston chamber 102 against the spring bias, as illustrated in FIG. 6. Continued rotation of cam 118 causes cam lip 122 to rotate past stop 117 thereby disengaging the cam from the stop, and allowing piston 101 to be biased forwardly into the piston chamber 102.

The pump 70 includes an inlet member 123 having a one-way valve (not shown) incorporated therein. The inlet member 123 extends through front wall 126 of fluid reservoir 72, as shown in FIG. 4. Reservoir 72 also includes walls 127 which, along with wall 126, are sealed to housing 68. A suction tube 128 extends from inlet member 123 into the reservoir 72 to draw fluid into the front of chamber 101 when piston 100 moves rearwardly within the chamber. Outlet member 129 on chamber 102 includes a corresponding one-way valve (not shown) which is adapted to allow fluid to flow from chamber 102 to tube 82 when piston 101 moves forwardly within the chamber. The reservoir 72 is replenished with fluid through a removable cap 130 (FIG. 1) located on the housing 68 of the pumping mechanism.

The operation of the pumping mechanism is as follows. Initially, sliding switch 98 is set to an operating position. The bellows 76 are initially collapsed or deflated and contact members 88, 89 are biased together to complete the electrical circuit between batteries 96 and pump motor 100 to activate the pump. The motor 100 rotates the cam 118, which in turn engages the stop 117 on the shoulder member 108. As the cam 118 turns, the piston 101 is drawn rearwardly out of the piston chamber 102 against the bias of spring 110, as shown in FIG. 6.

As the piston 101 moves rearwardly within the chamber 102, the pressure drops in the chamber. As the pressure drops, fluid flows through the one-way valve in inlet member 123 and into the front of the piston chamber. After the fluid enters the chamber, the one-way valve prevents the fluid from returning to the reservoir. The cam 118 continues to draw the piston 101 rearwardly out of chamber 102 until cam lip 122 rotates past stop 117, whereby the spring 110 forces the piston 101 forwardly within the chamber, as illustrated in FIG. 5. As the piston is forced forwardly into the piston chamber, the fluid is forced through the one-way valve on the outlet member 130 and through the pressure sensitive switch 74 to the spray device 10 (FIG. 1). Continued rotation of the cam begins to again draw the piston rearwardly out of the piston chamber to provide another pulse of fluid from the pump.

If the button 30 on the spray device is manually depressed and the fluid passage through the device is uninterrupted, the fluid continues to pass through the spray device and out through the nozzle 20 (FIG. 1) in a stream or spray. The flexibility of the bellows tends to dampen the pulsating effect of the pump and provide a substantially uniform and continuous stream of fluid through the nozzle of the spray device.

If the button 30 is released and the flange of the fluid cut-off member is biased into engagement with the fluid passage, the fluid is prevented from passing through the nozzle. Consequently, the pressure in the fluid passage 27 (FIG. 2), the fluid conduit 15 (FIG. 1) and the bellows 74 (FIG. 4) increases with the continued activation of the pump motor. An increase in fluid pressure in the flexible bellows causes the bellows to expand, as shown in FIG. 7. As the bellows expand, the contact members 88, 89 are moved out of electrical engagement with each other. When the contact members disengage, the electrical continuity between the pump motor and the batteries is interrupted and the motor ceases to operate.

To cause the spray device to again emit a stream of fluid, the button is depressed, and the pressurized fluid passes through the nozzle in the spray device. The decrease in fluid pressure in the fluid passage and fluid conduit deflates the bellows, and the contact members engage to again activate the pump motor. To interrupt the operation of the pumping mechanism, the sliding switch is set to a non-operating position.

Consequently, when the bellows are deflated, such as when the button is depressed and there is a decrease is fluid pressure, the contact members are biased together and electrically engage each other, thereby completing the electrical circuit between the pump and the batteries. However, when the bellows are expanded, such as when the button is released, the contact members are moved out of engagement with each other, thereby interrupting the electrical continuity and inactivating the pump.

The spray device herein described is particularly designed to be incorporated within an apparatus such as a toy. The toy is adapted to be used with other toys having similar spraying devices incorporated therein. The housing for the pumping mechanism can be attached to a belt, or can remain on a support surface. In any case, the spray device can have a portion which is covered by a heat-activated paint. Such paint is adapted to change colors when contacted with water, particularly when the water is at a different temperature than the ambient temperature. A preferred type of heat-activated paint is marketed under the trademark Pilot Ink by the Pilot Ink Company.

Figure 9:
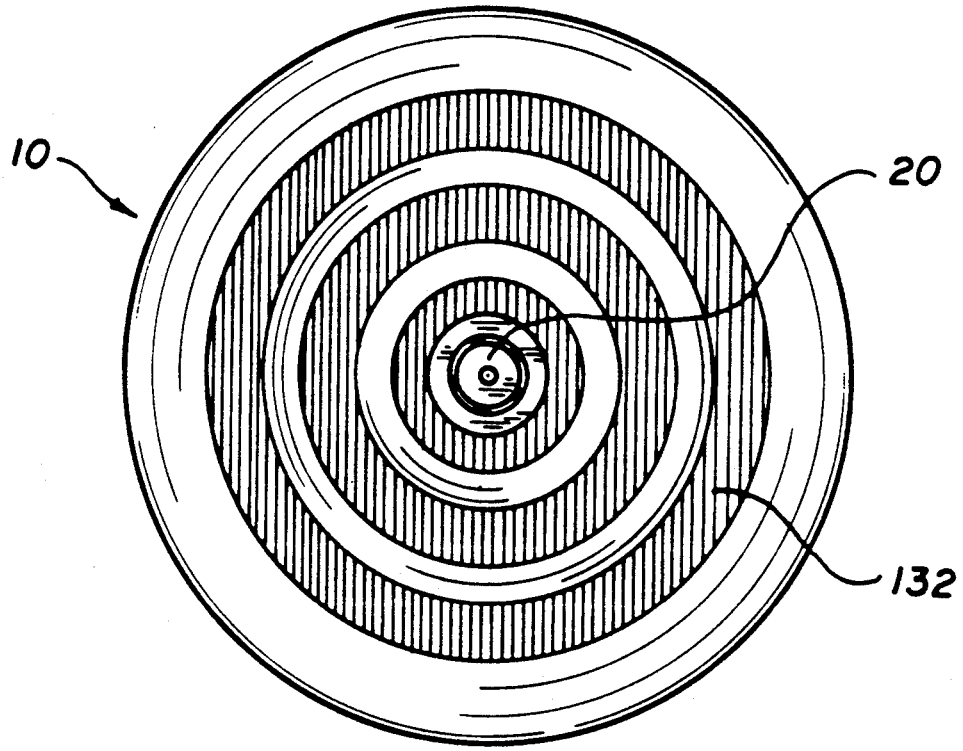
FIG. 9 is a front view of the spray device, taken substantially along the plane described by the line 9—9 in FIG. 1, illustrating an exemplary color pattern on the device.

The paint can be applied to a portion of the spray device that would typically be in a position to be struck by a stream of fluid emanating from other toys, and can be in any predetermined design. For example, the paint can be applied to the device 10 in the shape of a bull's eye, as illustrated in FIG. 9, such that when water is applied to the paint, the different concentric circles in the bull's eye, for example as indicated at 132, change colors. The paint may also be applied in other predetermined designs, such as stars or flames. In any event, the spray assembly is adapted to be used in simulated water combat, such that the heat-activated paint on the spray device changes color to indicate that a "hit" has occurred, and thereby increase the enthusiasm for the toy.

The principles, preferred embodiment and modes of operation of the present invention have been described in the foregoing specification. The invention which is intended to be protected herein should not, however, be construed as limited to the particular form described as it is to be regarded illustrative rather than restrictive. Variations and changes may be made by those skilled in the art without departing from the spirit of the invention. Accordingly, the foregoing detailed description should be considered exemplary in nature and not as limited to the scope and spirit of the invention set forth in the appended claims.

What is claimed is:

1. An apparatus for pumping fluids, comprising:

a spray device having a body with a fluid passage and a spray nozzle, said spray device including control means enclosed at least partially by said body adapted to be selectively moved between an open position to allow fluid to flow through the fluid passage to said spray nozzle, and a closed position to restrict the fluid flow in the fluid passage to said spray nozzle, a pumping mechanism having a housing enclosing a pump, a pressure sensitive switch for activating and deactivating the pump, a source of electrical potential, and an electrical circuit interconnecting the pump, the pressure sensitive switch and the source of electrical potential, and a fluid conduit connecting the fluid passage of the spray device with the pump of the pumping mechanism, said pressure sensitive switch including expandable means responsive to the fluid pressure in the fluid conduit, said expandable means including electrical contact means integral with said electrical circuit, wherein when said control means is in the closed position, the fluid pressure in said fluid conduit increases in a manner to expand said expandable means and open the electrical circuit between said contact means to inactivate said pump, and when said control means is in the open position, the fluid pressure in said fluid conduit decreases in a manner to deflate said expandable means and close the electrical circuit between said contact means to activate said pump and provide fluid under pressure to said fluid passage in said spray device.

2. An apparatus as in claim 1, wherein said control means includes a fixed member in engagement with one side of said fluid passage and an engagement member normally biased into engaging relationship with the other side of said fluid passage opposite from said fixed member to restrict the fluid flow in the passage, said engagement member being adapted to be moved against the bias to allow the fluid to flow within the passage.

3. An apparatus as in claim 1, wherein said pumping mechanism includes a reciprocating piston slidably received within a chamber, said chamber including a fluid inlet port fluidly connected to a fluid reservoir, and a fluid outlet port fluidly connected to the pump.

4. An apparatus as in claim 3, further including a rotatable cam mounted in said pumping mechanism, said piston including a stop extending therefrom adapted to be alternatively engaged and disengaged by said rotatable cam.

5. An apparatus as in claim 1, wherein said expandable means includes a bellows comprised of flexible material and said contact means includes strips of conductive material extending at least partially over the circumference of said bellows and biased into electrical contact, said bellows adapted to expand when said pump is activated and said control means is in the closed position to move said strips apart and open the electrical circuit.

6. An apparatus as in claim 1, wherein at least a portion of the surface of said spray device includes a layer of color changing paint, said color changing paint adapted to change from a first color to a second color when contacted with fluid.

7. An apparatus as in claim 1, wherein said electrical circuit further includes a switch, said switch selectively operable to open or close a portion of said circuit.

8. An apparatus as in claim 1, wherein said source of electrical potential includes at least one battery.

9. An apparatus for pumping fluids, comprising:

a spray device having a housing at least partially enclosing a fluid passage and a control means, said fluid passage extending between an inlet fluid port and an outlet fluid port in said housing, and said control means selectively controlling the fluid flow between said ports, a pumping mechanism having a housing enclosing a pump, a pressure sensitive switch for activating and deactivating the pump, a source of electrical potential, and an electrical circuit interconnecting the pump, the switch and the source of electrical potential, and a fluid conduit connecting said inlet fluid port of said spray device with said pump of said pumping mechanism, and said pressure sensitive switch having a portion located within said fluid conduit and including means expandable in response to an increase in fluid pressure in the fluid conduit for opening and closing the electrical circuit and selectively activating or inactivating said pump.

10. An apparatus as in claim 9, wherein said control means is adapted to selectively move between an open position to allow fluid to flow between the ports, and a closed position to prevent the fluid from flowing between the ports, whereby when said control means is in said closed position, the pressure in said fluid conduit increases a manner to deactivate said pump, and when said control means is in said open position, the pressure in said fluid conduit decreases in a manner to activate said pump.

11. An apparatus as in claim 10, wherein said control means includes a fixed member in engagement with one side of said fluid passage and an engagement member normally biased into engaging relationship with the other side of said fluid passage opposite from said fixed member to restrict the fluid flow in the passage.

12. An apparatus as in claim 1, wherein said pressure sensitive switch includes bellows adapted to expand or deflate in response to a change in fluid pressure in the fluid conduit.

13. A method for controlling a pumping mechanism for a spray assembly, comprising:

attaching the pumping mechanism to a belt of the user, initially manually activating a control switch to operate a pump in the pumping mechanism and provide fluid from the pumping mechanism under pressure to a fluid passage in a spray device, initially interrupting the flow of fluid through the fluid passage in the spray device by biasing an engagement member into engagement with the fluid passage, thereby causing the fluid pressure to increase in the fluid passage, said increase in pressure in the fluid passage expanding a bellows in the pumping mechanism when the flow of fluid in the fluid passage is interrupted, and selectively manually manipulating the spray device and allowing fluid to flow through the fluid passage in the spray device, thereby causing the fluid pressure to decrease in the fluid passage and to deflate the bellows and thereby activate the pump in the pumping mechanism.

14. An apparatus as in claim 5, wherein said bellows are designed to expand a predetermined amount to substantially dampen pressure fluctuations received from the pump and thereby provide a substantially uniform and continuous stream of fluid through the spray nozzle of the spray device.

15. An apparatus as in claim 12, wherein said bellows are designed to expand a predetermined amount to substantially dampen pressure fluctuations received from the pump to provide a substantially uniform and continuous stream of fluid through the spray nozzle of the spray device.

16. An apparatus as in claim 2, wherein said engagement member comprises a button received within a bore extending inwardly into said body which is adapted to be manually manipulated into engagement with a portion of the fluid passage to prevent fluid from flowing therethrough when said control means is in said closed position.

17. An apparatus as in claim 16, wherein said button comprises an outer body with a hollow central portion and apertures formed in opposite sides of the button body, said fluid passage extending through said apertures in said button body and being engaged by a portion of said button body to prevent fluid from flowing through said fluid passage when said control means is in said closed position.

18. An apparatus as in claim 17, wherein said fixed member is located within the hollow central portion of said button body.

19. An apparatus for pumping fluids, comprising:

a spray device having a housing at least partially enclosing a fluid passage and a control means, said fluid passage extending between an inlet fluid port and an outlet fluid port in said housing, and said control means selectively controlling the fluid flow between said ports, said control means including a fixed member in engagement with one side of said fluid passage and an engagement member normally biased into engaging relationship with the other side of said fluid passage opposite from said fixed member to restrict the fluid flow in the passage, said control means being adapted to selectively move between an open position to allow fluid to flow between the ports, and a closed position to prevent the fluid from flowing between the ports, whereby when said control means is in said closed position, the pressure in said fluid conduit increases in a manner to deactivate said pump, and when said control means is in said open position, the pressure in said fluid conduit decreases in a manner to activate said pump, said engagement member including a button received within a bore extending inwardly into the housing for engaging a portion of the fluid passage to prevent fluid from flowing therethrough and thereby selectively controlling the fluid flow between said ports when said control means is in said closed position, a pumping mechanism having a housing enclosing a pump and a pressure sensitive switch for activating and deactivating the pump, and a fluid conduit connecting said inlet fluid port of said spray device with said pump of said pumping mechanism, and said pressure sensitive switch having a portion located within said fluid conduit and including means expandable in response to an increase in fluid pressure in the fluid conduit for selectively activating or inactivating said pump.

20. An apparatus as in claim 19, wherein said button comprises an outer body with a hollow central portion and apertures formed in opposite sides of the button body, said fluid passage extending through said apertures in said button body and being engaged by a portion of said button body to prevent fluid from flowing through said fluid passage when said control means is in said closed position.

21. An apparatus for pumping fluids in a toy, comprising:

a spray device having a body with a fluid passage and a spray nozzle, said spray device including a button received within a bore extending inwardly into the body and adapted to be selectively moved between an open position disengaged from the fluid passage to allow fluid to flow through the fluid passage to said spray nozzle, and a closed position in engagement with the fluid passage to restrict the fluid flow in the fluid passage to said spray nozzle, a pumping mechanism having a housing enclosing a pump, a pressure sensitive switch for activating and deactivating the pump, at least one battery, and an electrical circuit interconnecting the pump, the pressure sensitive switch and the battery, and a fluid conduit connecting the fluid passage of the spray device with the pump of the pumping mechanism, said pressure sensitive switch including expandable means responsive to the fluid pressure in the fluid conduit, said expandable means including electrical contact means integral with said electrical circuit, wherein when said button is in the closed position, the fluid pressure in said fluid conduit increases in a manner to expand said expandable means and open the electrical circuit between the contact means to inactivate the pump, and when said button is in the open position, the fluid pressure in said fluid conduit decreases in a manner to deflate said expandable means and close the electrical circuit between said contact means to activate said pump and provide fluid under pressure to said fluid passage in said spray device.

22. An apparatus as in claim 21, wherein said button comprises an outer body with a hollow central portion and apertures formed in opposite sides of the button body, said fluid passage extending through said apertures in said button body and being engaged by a portion of said button body to prevent fluid from flowing through said fluid passage when said control means is in said closed position.

23. An apparatus for pumping fluids in a toy, comprising:

a spray device having a housing enclosing a fluid passage and a control assembly, said fluid passage extending between an inlet fluid port and an outlet fluid port in said housing, said control assembly including a button received within a bore extending inwardly into the housing for engaging a portion of the fluid passage to prevent fluid from flowing therethrough and thereby selectively controlling the fluid flow between said ports, a pumping mechanism having a housing enclosing a pump, a pressure sensitive switch for activating and deactivating the pump, a source of electrical potential, and an electrical circuit interconnecting the pump, the switch and the source of electrical potential, a fluid conduit connecting said inlet fluid port of said spray device with said pump of said pumping mechanism, and said pressure sensitive switch having a portion located within said fluid conduit, said portion being expandable in response to an increase in fluid pressure in the fluid conduit for opening and closing the electrical circuit and selectively activating or deactivating said pump.

24. An apparatus as in claim 23, wherein said button comprises an outer body with a hollow central portion and apertures formed in opposite sides of the button body, said fluid passage extending through said apertures in said button body and being engaged by a portion of said button body to prevent fluid from flowing through said fluid passage when said control means is in said closed position.

25. An apparatus for pumping fluids, comprising:

a spray device having a body with a fluid passage and a spray nozzle, said spray device including a control device adapted to be selectively moved between an open position disengaged from said fluid passage to allow fluid to flow through the fluid passage to said spray nozzle, and a closed position in engagement with said fluid passage to restrict the fluid flow in the fluid passage to said spray nozzle, a pumping mechanism having a housing enclosing a pump; a pressure sensitive switch for activating and deactivating the pump; a source of electrical potential; a fluid reservoir; an electrical circuit interconnecting the pump, the pressure sensitive switch and the source of electrical potential; and a manually operable switch for selectively interrupting the electrical circuit, said pump including a reciprocating piston slidably received within a chamber, said chamber including a fluid inlet connected to said fluid reservoir, and a fluid outlet connected to the pump, said reciprocating piston providing fluid through said fluid outlet at a pulsating rate, a fluid conduit connecting the fluid passage of the spray device with the fluid outlet of the pump of the pumping mechanism, said pressure sensitive switch having a bellows portion comprised of flexible material which is expandable in response to an increase in the fluid pressure in the fluid conduit, said pressure sensitive switch including electrical contact means comprising strips of conductive material extending at least partially over the circumference of the bellows portion and being integral with said electrical circuit for completing said electrical circuit when said bellows portion is not expanded, wherein when said control device is in the closed position, the fluid pressure in said fluid conduit increases in a manner to expand said bellows portion and open the electrical circuit between said electrical contact means to inactivate said pump, and when said control device is in the open position, the fluid pressure in said fluid conduit decreases in a manner to deflate said bellows portion and close the electrical circuit between said contact means to activate said pump and provide fluid under pressure to said fluid passage in said spray device, said bellows portion being designed to expand a predetermined amount to substantially dampen pressure fluctuations received from the pump to provide a substantially uniform and continuous stream of fluid through the outlet port of the spray device.

26. An apparatus for pumping fluids, comprising:

a spray device having a body with a fluid passage and a spray nozzle, said spray device including a control assembly having a button received within a bore extending inwardly into the body, wherein the button is designed to be manually manipulated between a closed position in engagement with a portion of said fluid passage to restrict the fluid flow in the fluid passage to said spray nozzle, and an open position out of engagement with said fluid passage to allow fluid to flow through the fluid passage to said spray nozzle, a pumping mechanism having a housing enclosing a pump, a switch for activating and deactivating the pump, a source of electrical potential, and an electrical circuit interconnecting the pump, the switch and the source of electrical potential, and a fluid conduit connecting the fluid passage of the spray device with the pump of the pumping mechanism, wherein when said button is in the closed position, the fluid pressure in said fluid conduit increases and the switch deactivates the pump, and when said button is in the open position, the fluid pressure in said fluid conduit decreases and the switch activates the pump to provide fluid under pressure to said fluid passage in said spray device.

27. A method as in claim 13, wherein said step of selectively manually manipulating the spray device comprises forcing the engagement member inwardly into the spray device and out of engagement with the fluid passage.

* * * * *